US005236524A

United States Patent [19]

Rawers et al.

[11] Patent Number: 5,236,524

[45] Date of Patent: Aug. 17, 1993

[54] METHOD FOR IMPROVING THE CORROSION RESISTANCE OF A ZIRCONIUM-BASED MATERIAL BY LASER BEAM

[75] Inventors: James C. Rawers, Albany, Oreg.; Wayne E. Reitz, Oakland, Calif.

[73] Assignee: The Babcock & Wilcox Company, New Orleans, La.

[21] Appl. No.: 826,320

[22] Filed: Jan. 21, 1992

[51] Int. Cl.[5] ..... C22F 3/00

[52] U.S. Cl. ..... 148/512; 148/422; 148/672; 219/121.85

[58] Field of Search ..... 148/672, 422, 512; 219/121.85

[56] References Cited

U.S. PATENT DOCUMENTS 4,294,631 10/1981 Anthony et al. ..... 219/121.85
4,909,859 3/1990 Nazmy et al. ..... 148/903
4,964,967 10/1990 Hashimoto et al. ..... 148/903

*Primary Examiner*—Upendra Roy
*Attorney, Agent, or Firm*—Robert J. Edwards; D. Neil LaHaye

[57] ABSTRACT

A method for improving the corrosion resistance of a zirconium-based material in an acid environment. A laser beam is scanned across the entire surface of the material to cause surface melting of the material. A rapid self-quenching is provided by the underlying substrate. Homogeneous material formed during solidification of the molten pool improves the corrosion resistance. Alloy enriched diffuse regions, i.e., tin and iron, develop parallel to each other and the periphery of the edge of the melt pool. In this manner, the laser surface melting removes the intermetalics by dissolving the precipitates, thus removing the source of localized corrosion. This greatly reduces the capability of the iron to act anodically to cause the zirconium to ionize, disassociate from the matrix, and migrate into the acid solution.

2 Claims, 1 Drawing Sheet

METHOD FOR IMPROVING THE CORROSION RESISTANCE OF A ZIRCONIUM-BASED MATERIAL BY LASER BEAM

BACKGROUND OF THE INVENTION

1. Field of the Invention

The present invention is generally related to the treatment of zirconium alloys and, more particularly to treatment to improve surface corrosion performance of zirconium-based material.

2. General Background

Zirconium alloys are widely used in the nuclear industry as cladding and structural materials. Zirconium is a widely accepted material because it has a low neutron absorption cross-section, suitable mechanical properties for intended uses, and a relatively good corrosion resistance. However, the severe environments in which zirconium has been used has led to a variety of approaches to improve its corrosion resistance. Patents of which applicants are aware include the following.

U.S. Pat. No. 4,294,631 discloses a method for improving the corrosion resistance of a body of zirconium alloy to high pressure and high temperature steam. A scanning laser beam heats a surface region substantially equally, without melting, to a temperature range to form a barrier layer of corrosion resistant beta-quenched zirconium alloy at the treated surface.

U.S. Pat. No. 4,718,949 discloses a method of producing a cladding tube for reactor fuel. A zirconium alloy is hot extruded to form a tube and cold rolled and annealed. The annealing is done by heating the inner surface of the tube to a higher temperature than the recrystallization temperature of the zirconium alloy while cooling the outer surface of the tube.

U.S. Pat. No. 4,648,912 discloses a method for improving the high temperature steam corrosion resistance of an alpha zirconium alloy body. The method uses a high energy beam thermal treatment to provide a layer of beta treated microstructure on an alpha zirconium alloy intermediate product. The treated product is then alpha worked to final size.

U.S. Pat. No. 4,279,667 discloses a zirconium alloy having enhanced corrosion resistance to a high pressure and high temperature steam environment by providing an integral surface region of beta-quenched zirconium formed by laser beam scanning.

U.S. Pat. No. 4,576,654; 4,584,030; 4,636,267; 4,664,727; 4,671,826; 4,690,716; 4,717,428; 4,770,847; and 4,879,093 disclose a Variety of methods that involve heat treatment of zirconium based materials.

The known art is directed mainly to annealing by heating or the formation of beta crystals for improved corrosion resistance in boiling or pressurized water reactors and high pressure steam environments. This leaves a need for zirconium-based materials having an improved corrosion resistance in acid environments.

SUMMARY OF THE INVENTION

The present invention addresses the aforementioned need in a straightforward manner. What is provided is a treatment method using a laser. The material is treated by rastering a laser beam over the entire surface with an overlap to insure complete coverage. The velocity of the laser beam is controlled to cause laser surface melting of the material to depths of 0.5–1.0 millimeter. An extremely rapid self-quench is provided by the underlying substrate.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
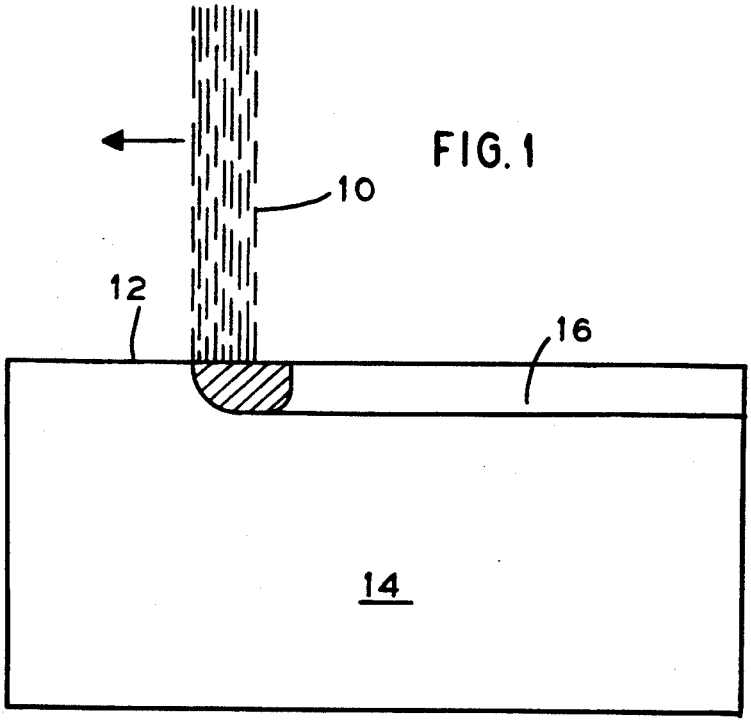
FIG. 1 is a schematic illustration of the treatment method of the invention.

The treatment method of the invention is schematically illustrated in FIG. 1. A laser beam such as a $CO_2$ continuous wave laser 10 is directed on to and across the surface 12 of zirconium-based material 14. Region 16 is heated to a temperature range that causes surface melting to a depth of 0.5–1.0 millimeter. As the laser beam 10 scans across the surface 12, the underlying substrate provides an extremely rapid self-quench. The preferred self-quench is on the order of $10^4$ to $10^8$ degrees K./second. The resulting structure is a fine martensite, illustrated in FIG. 2. The laser beam 10 is scanned over the entire surface 12 of material 14 with an overlap of each laser beam scan to insure complete coverage. A fifty percent overlap may be used.

Figure 3:
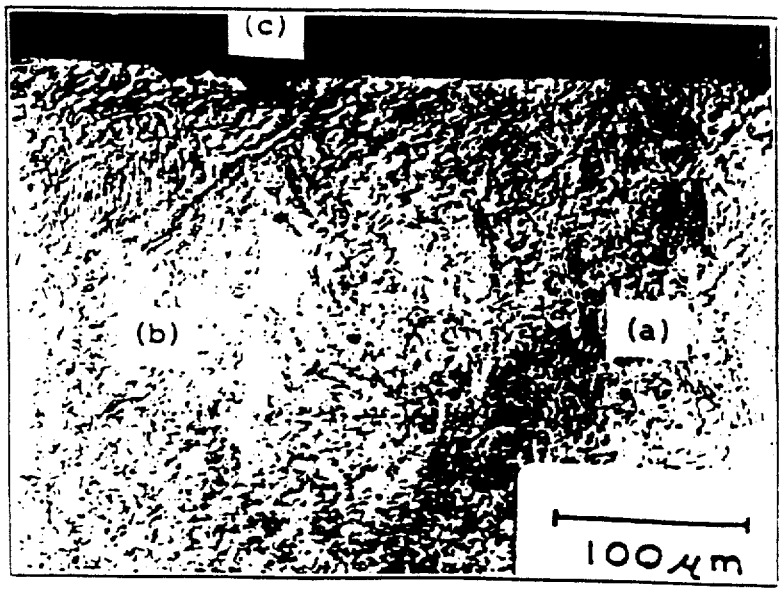
FIG. 3 is an illustration of a transverse section of zircaloy-4 after treatment.

The laser surface melting of the zirconium-based material produces a metastable supersaturated solid solution. The improved corrosion resistance in an acid environment is due to the supersaturated solid solution. As the molten pool solidifies, tin (Sn) is rejected to the lower temperature alpha phase and defines the melt pool periphery. As the pool continues to solidify, iron (Fe) is rejected to the beta phase during an intermediate step of the quenching process adjacent to the tin-defined melt pool periphery. This is illustrated in FIG. 3, which is a transverse section of treated (laser surface melted) zircaloy-4. The darkened area (a) indicates the tin-rich region that defines the periphery of the melt pool. The lighter area (b) indicates the iron-rich region parallel to the tin rich region (a) Area (c) indicates a pit initiation site.

Figure 2:
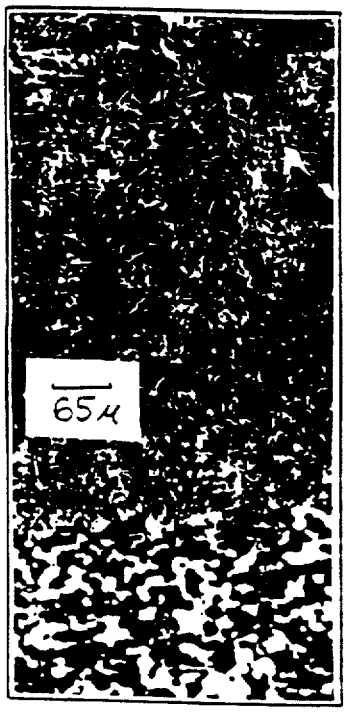
FIG. 2 is an illustration of the resulting microstructure after treatment.
Figure 1:
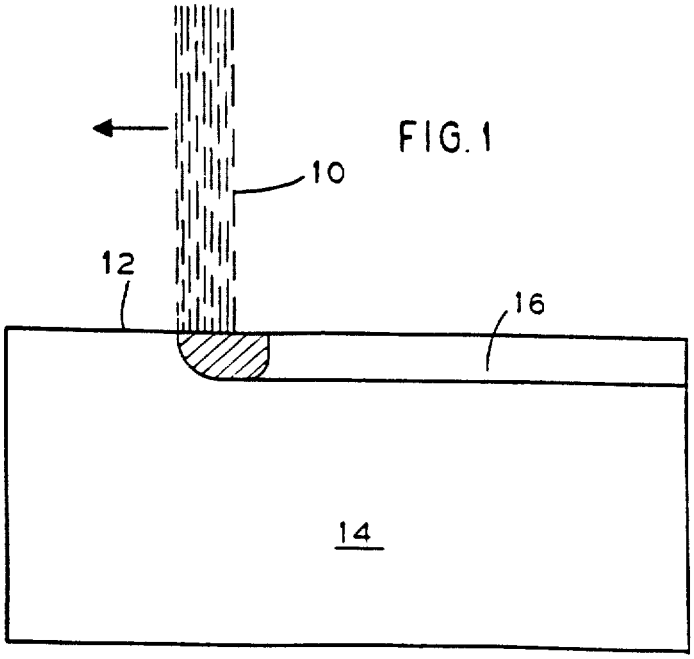

In an acid environment, the zirconium atoms behave cathodically and the alloying elements, iron in particular, behave anodically. Both iron and zirconium elements are necessary for corrosion to occur. In an acid environment, the chemical corrosion reaction results in the zirconium ionizing, disassociating from the matrix, and migrating into the acid solution. Since the iron-rich areas are localized in a particular region of the laser pass zone, pitting tends to occur in these areas. The iron-rich areas promote the dissolution of zirconium ions from the matrix, resulting in a pit. The increased homogeneity and lower iron concentration everywhere else in the laser treated surface provides a pit resistant surface and reduces the general corrosion rate. The iron-rich regions are spread out over an extended area. This provides a diffused band that is in contrast to the iron intermetallic precipitates (discrete sites) that are present before treatment by the present inventive method. The chance of forming a corrosion pit is significantly reduced since the precipitates, which are the corrosion initiation sites in an acid environment, are not present on the surface exposed to the acid environment. In addition, the limited concentration of iron in region 16 is extremely low in comparison to the iron intermetallic local concentration and thus limits the extent of pitting corrosion. In FIG. 2 and 3 the solid dark area located at the top of each Figure and indicated by the dimension A represents the mounting material typically used to mount specimens for ease of metallographic preparation and do not constitute part of the invention.

Typically, zirconium wrought product has a corrosion rate of 30–300 mils per year (mpy) in 10% $FeCl_3$. Tests indicate that pure zirconium, ziraloy-702, and zircaloy-4 treated by the method of the invention exhibit corrosion rates of only 0.3–1.0 mpy in 10% $FeCl_3$. If pitting does occur, it is located near the overlap regions of laser beam 10. Tests of treated materials in a steam autoclave (400 degrees C. at 10.3 MPa) indicate the presence of faster nodular corrosion near the overlap region of laser beam 10. However, the center portion of each laser beam pass is free of nodular corrosion.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for improving the corrosion resistance of a zirconium-based material to an acid environment, comprising the steps of:

a. melting the surface of said material to a depth of one-half to one millimeter by scanning a continuous wave laser beam across the entire surface of said material with an overlap of each laser beam scan; and b. quenching the melted surface at a rate wherein tin in said material is rejected to the lower temperature alpha phase and defines the melt pool periphery and wherein iron in said material is rejected away from the tin to a beta phase during an intermediate step of the quenching process adjacent to the tin-defined melt pool periphery.

2. The method of claim 1, wherein said quenching is at a rate of $10^4$ to $10^8$ degrees Kelvin per second.

* * * * *

UNITED STATES PATENT AND TRADEMARK OFFICE

CERTIFICATE OF CORRECTION

PATENT NO. : 5,236,524

DATED : August 17, 1993

INVENTOR(S) : Rawers et al.

It is certified that error appears in the above-indentified patent and that said Letters Patent is hereby corrected as shown below:

Delete Drawing sheet, consisting of Fig. 1, and substitute therefor the Drawing sheet, consisting of Figs. 1-3, as shown on the attached page.

Signed and Sealed this

Twelfth Day of April, 1994

Bruce Lehman

*Attest:*

BRUCE LEHMAN

*Attesting Officer*

*Commissioner of Patents and Trademarks*